US005971714A

United States Patent [19]

Schaffer et al.

[11] Patent Number: 5,971,714

[45] Date of Patent: Oct. 26, 1999

[54] ELECTRONIC CAM COMPENSATION OF PRESSURE CHANGE OF SERVO CONTROLLED PUMPS

[75] Inventors: Eric J. Schaffer, Eden Prairie; Neal A. Werner, Bloomington; James J. Handzel, Golden Valley, all of Minn.

[73] Assignee: Graco Inc, Minneapolis, Minn.

[21] Appl. No.: 08/863,115

[22] Filed: May 27, 1997

Related U.S. Application Data

[60] Provisional application No. 60/018,552, May 29, 1996.

[51] Int. Cl.[6] ..... F04B 49/08

[52] U.S. Cl. ..... 417/44.2; 417/53

[58] Field of Search ..... 417/44.1, 44.2, 417/53, 45, 15, 28, 41; 604/65; 364/152

[56] References Cited

U.S. PATENT DOCUMENTS 4,950,235 8/1990 Slate et al. ..... 604/65
5,457,626 10/1995 Wolze ..... 364/152

*Primary Examiner*—Charles G. Freay
*Assistant Examiner*—Robert Z. Evora
*Attorney, Agent, or Firm*—Douglas B. Farrow

[57] ABSTRACT

The construction and operation of the control of this invention is designed to minimize pressure changes at pump changeover by sampling pump pressure characteristics for each pump cycle, calculating a compensating motion profile and applying the profile to the motor which drives the pump. This control can be used with any pump which has the following characteristics: positive displacement, repeating cycle characteristics, rotary motor drive and an output pressure cycle curve which never falls to zero.

4 Claims, 2 Drawing Sheets

ELECTRONIC CAM COMPENSATION OF PRESSURE CHANGE OF SERVO CONTROLLED PUMPS

RELATED APPLICATIONS

This application is a of Provisional Application serial No. 60/018,552, filed May 29, 1996.

BACKGROUND OF THE INVENTION

Various types of pumps have been used for transfer and circulation of fluids for many years. In many cases the desirable pump design is a piston pump however one of the less desirable aspects of such piston pumps has been that such pumps are prone to output pulsation which requires either compensation or the willingness to live with such pulsation. One such attempt at reducing pulsation is shown in U.S. Pat. No. 5,145,339, the contents of which are incorporated by reference. While such a construction is a substantial advance over other prior art designs, some pulsation does remain.

SUMMARY OF THE INVENTION

It is an object of this invention to provide a piston type pump which is substantially free of pulsation and yet which retains the desirable aspects of a piston pump.

Other pumps which also enjoy at least some pulsation include gear pumps and lobe pumps. This invention is applicable to all such pumps in order to decrease pulsation.

The construction and operation of the control of this invention is designed to minimize pressure changes at pump changeover by sampling pump pressure characteristics for each pump cycle, calculating a compensating motion profile and applying the profile to the motor which drives the pump. In fact, this control can be used with any pump which has the following characteristics: positive displacement, repeating cycle characteristics, rotary motor drive and an output pressure cycle curve which never falls to zero.

This control system is thus able to minimize the fluctuations in pressure at pump changeover. Additionally, it has the ability to adaptively modify motion profiles to compensate for condition changes such as rate changes, material changes (viscosity, etc.). It also has the ability to diagnose pump performance, deterioration and failure.

Previous attempts to create pulseless output have used mechanical methods such as the aforementioned U.S. Pat. No. 5,145,339. While attempts have been made to compensate for pressure changes by electronically closing the velocity loop or maintaining a constant torque load at the motor, these methods are reactionary and thus have a tendency to overcompensate and be delayed due to the high inertia of the system. This is particularly true since the pressure changes tend to be relatively quick pulses especially as pumps reach higher flow levels and higher speeds. To reduce overcompensation, gains may be lowered but then the pulsation will be reduced and not eliminated.

The object of this solution of continually sampling the output pressure curve of the pump and calculating a true compensating motion profile addresses both of these problems. Continuous sampling by the control can compensate for changing conditions and also diagnose pump degradation and failure. By modifying the motion profile of the pump simultaneously with the pressure change, overcompensation of the pressure output is eliminated. Also, by adjusting phase, the motion profile can compensate for mechanical lags in the system.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

FIG. 1 is a schematic of a pump control of the instant invention.

FIGS. 2*a* and 2*b* is a graph of actual response and calculated compensating response.

FIG. 3 is a graph of a singular compensating profile.

DESCRIPTION OF THE PREFERRED EMBODIMENT

Figure 1:
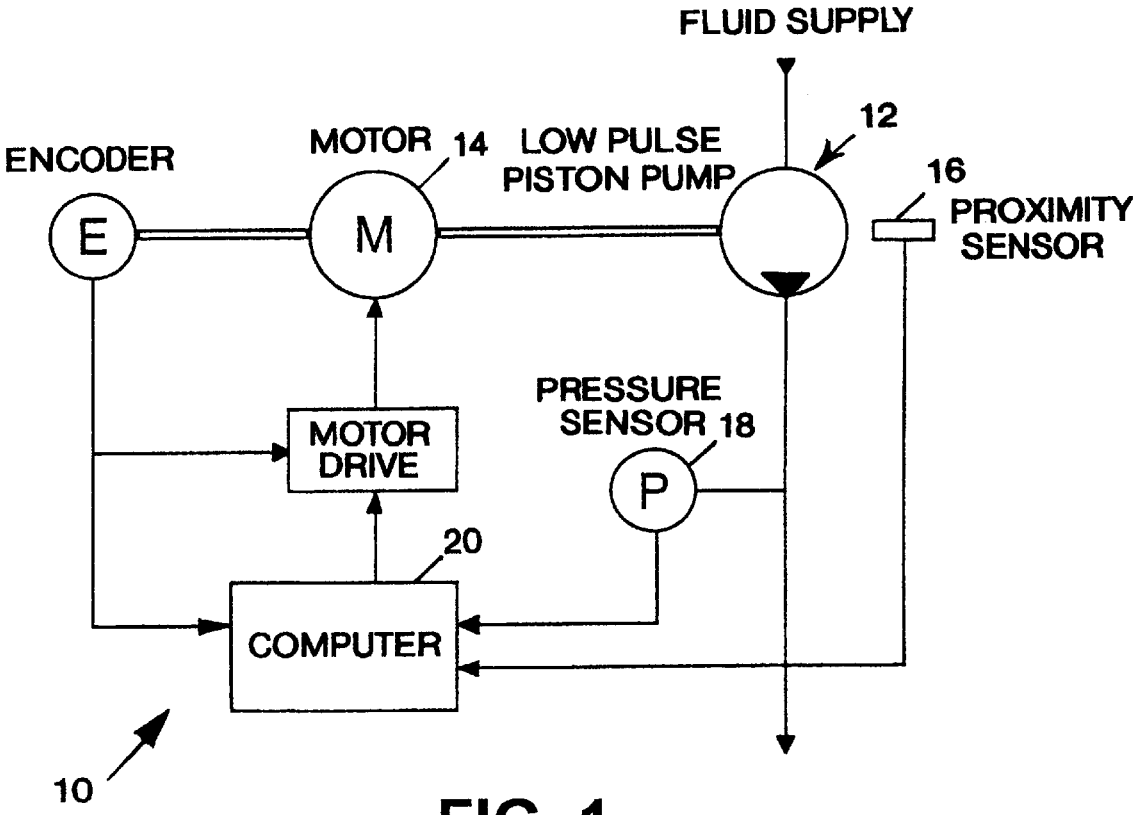

Illustrated in FIG. 1 is a system 10 consisting of a low pulse dual piston pump 12 driven by a servo motor 14. Of course, other pumps and motors may be utilized. The absolute position of the pump 12 is determined by a proximity sensor 16 tracking a singular position of the pump for each pump cycle and then an encoder determining the absolute position of the servo motor coupled to the pump.

Figure 2A:
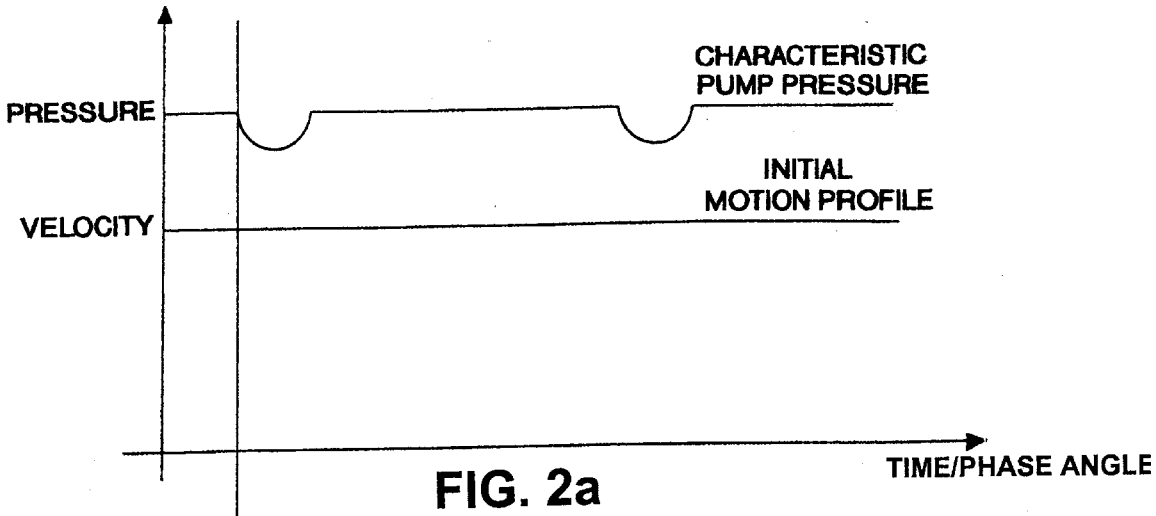
Figure 2B:
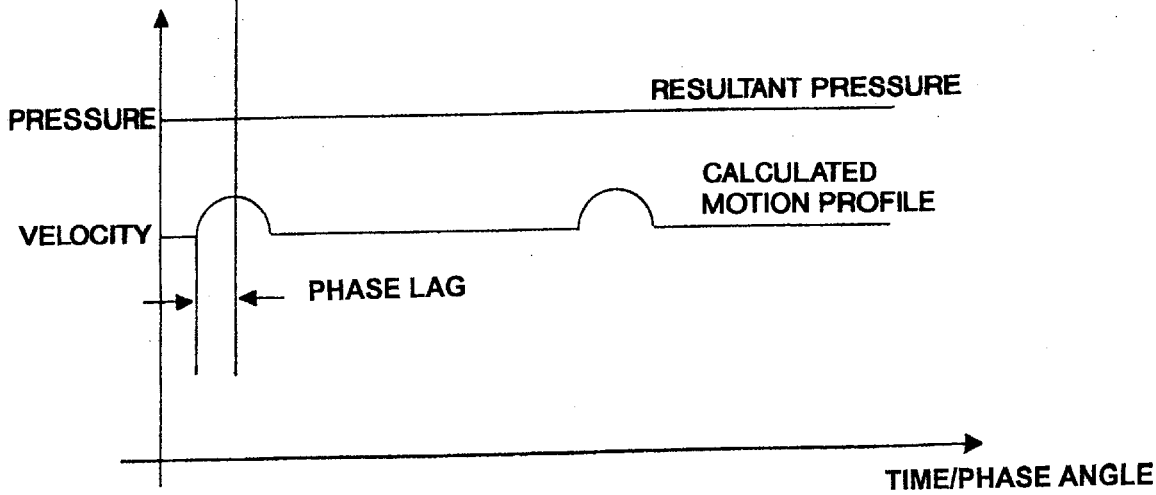

A pressure sensor 18 at the output of the pump 12 monitors the instantaneous pressure. A computer 20 records the pressure output of the pump 12 correlated with the absolute position of the pump 12. By analyzing the pressure curve for single or multiple cycles of the pump, a pressure curve versus position can be determined as shown in FIGS. 2*a* and 2*b*. Thus, compensating profile (also shown in FIGS. 2*a* and 2*b* can be calculated for the motor which when applied should result in a pulseless output.

This analysis in compensation can be repeatedly applied to continuously tune the system. By continuously monitoring the pressure, any condition that is out of the normal range of pump characteristics can be realized and an appropriate alarm supplied indicating a fault. In addition, continually growing compensation may well be evidence of deterioration and an alarm can be sounded at the appropriate time.

It is significant that a single phase advance may be a characteristic of a pump. This can be determined by observing the response delay of the output to a pressure spike input which can be easily ascertained during running. For example the output may lag an input by X degrees of motor/pump rotation.

Figure 3:
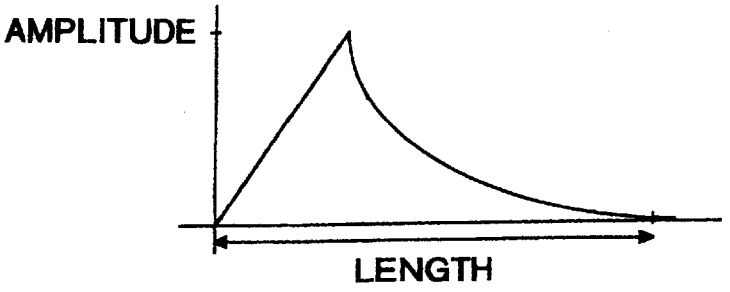

It appears that a singular compensating profile may be applicable to most pressure drops with its amplitude and length determined by the pressure drop amplitude, area and length. This would significantly reduce the calculations needed for the cam to compensate in real time. FIG. 3 might correspond to such a compensating profile.

It is contemplated that various changes and modifications may be made to the control system without departing from the spirit and scope of the invention as defined by the following claims.

What is claimed is:

1. In a multi-cylinder reciprocating pump having a rotary motor drive, the improvement comprising:

means for sampling the pressure curve for each pump cycle;

means for calculating a compensating pressure curve over substantially all of said cycle from said sampling means; and control means for said motor for applying said compensating pressure curve to remove pressure spikes which occur during changeover.

2. The multi-cylinder pump of claim 1 further comprising means for calculating the phase lag of a control input and compensating for said lag.

3. The multi-cylinder pump of claim 1 further comprising means for determining the rotary position of said motor.

4. A method for controlling a multi-cylinder reciprocating pump having a rotary motor drive, the improvement comprising the steps of:

sampling the pressure curve for each pump cycle during all of said cycle;

calculating a compensating pressure curve for all of said cycle from said sampling means; and controlling said motor by applying said compensating pressure curve to remove pressure spikes which occur during changeover.

* * * * *